United States Patent [19]

Hanna

[11] Patent Number: 4,763,379

[45] Date of Patent: Aug. 16, 1988

[54] CLEANING DEVICE

[76] Inventor: James M. Hanna, 78 Squire Hill Rd., New Milford, Conn. 06776

[21] Appl. No.: 28,653

[22] Filed: Mar. 20, 1987

[51] Int. Cl.[4] ..... A46B 15/00

[52] U.S. Cl. ..... 15/160; 15/210 R

[58] Field of Search ..... 15/160, 159 R, 171, 15/176, 162, 143 R, 146, 167 R, 49 R, 167.1, 208, 209 R, 209 D, 210 R, 228

[56] References Cited

U.S. PATENT DOCUMENTS

| | | | |
|---|---|---|---|
| 630,844 | 8/1899 | Barratt | 15/160 |
| 1,257,308 | 2/1918 | Boyle | 15/49 R |
| 1,420,180 | 6/1922 | Casmire | 15/160 |
| 1,801,964 | 4/1931 | Kuendig | 15/49 R |
| 2,130,661 | 9/1938 | Zaebst | 15/167 R |
| 2,232,269 | 2/1941 | Reuben | 15/167 R |
| 3,013,287 | 12/1961 | Descarries | 15/49 R |
| 3,128,487 | 4/1964 | Vallis | 15/176 |
| 3,451,495 | 6/1969 | Bayless et al. | 15/49 R |
| 4,103,382 | 8/1978 | Gitt | 15/145 |
| 4,325,157 | 4/1982 | Balint et al. | 15/49 R |
| 4,358,123 | 11/1982 | Richard | 15/246 |
| 4,449,266 | 5/1984 | Northemann et al. | 15/167 A |
| 4,486,913 | 12/1984 | Kubick | 15/146 |
| 4,670,931 | 6/1987 | Abbassi | 15/167 R |

FOREIGN PATENT DOCUMENTS

| | | | |
|---|---|---|---|
| 573225 | 3/1933 | Fed. Rep. of Germany | 15/159 |
| 588092 | 4/1925 | France | 15/160 |

*Primary Examiner*—Philip R. Coe
*Assistant Examiner*—Joseph S. Machuga
*Attorney, Agent, or Firm*—Stuart S. Bowie

[57] ABSTRACT

A hand tool facilitating removal of cobwebs and the like from ceilings, walls, baseboards and furniture without smudging the same and without the necessity of stooping or standing on an elevated support to accomplish the same. The tool is comprised of a circular base with a pair of opposing tracks or recesses provided therein adapted to engage and support a complementary nose piece thereon. The nose piece in turn has a lining or covering of flocking to attract cobwebs, dust and dirt, etc., and a plurality of spaced semi-circular projections along the exterior to prevent the entire surface from contacting and soiling the wall while in use. A socket is provided for receiving a handle to manipulate the same.

9 Claims, 3 Drawing Sheets

CLEANING DEVICE

BACKGROUND OF THE INVENTION

The present invention relates to a hand tool for removing cobwebs, dust and dirt from inconvenient places without undue labor. In cleaning cobwebs, for example, from ceilings, one usually relies on a dustmop, broom or the like for removing the same. The use of this type of a tool can cause additional problems in that due to their nature, they will smudge the wall with dirt accumulated thereon, which in turn will present a further cleaning operation. Numerous attempts have been made to facilitate cleaning of objectional material in an inconvenient place. These devices extend from hand tools provided with toweling or feathers to vacuum systems. These suffer from the disadvantage that they are not shaped to accommodate the wall surfaces.

No prior art device is known to offer the unique features of the present invention.

SUMMARY OF THE INVENTION

The cleaning tool of the present invention includes a base disposed on an elongated handle with a removable adjustably positioned nose piece disposed thereon having a cleaning surface on its exterior which will attract and remove cobwebs, dust and dirt. Since the nose piece and its attendant cleaning means is adjustable, the same can be moved to any angular position to accommodate the user, and space considerations. The user need not have to stoop, climb or use any undue energy in manipulating the tool.

The tool can be made from plastic, is easy to fabricate, assemble and use.

DESCRIPTION OF PREFERRED EMBODIMENTS

Figure 1:
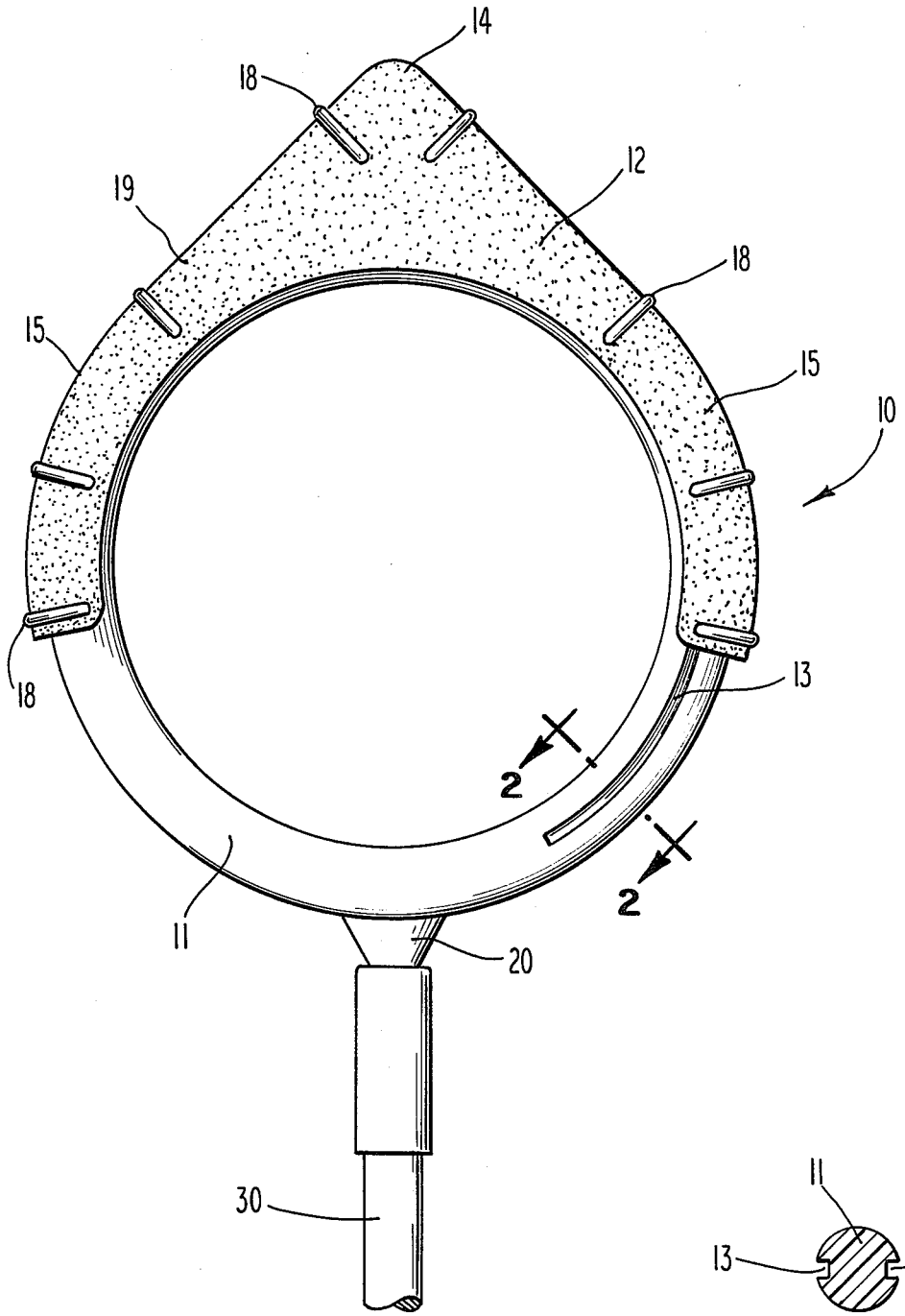
FIG. 1 is a front view of the cleaning head of the present invention showing the support base and associated nose piece in one position.
Figure 2:
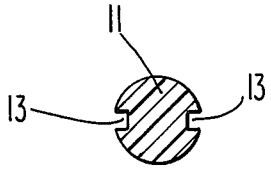
FIG. 2 is a sectional view taken along lines 2—2 of FIG. 1 and rotated 180°.

With reference to FIG. 1 of the drawing, the cleaning head of the hand tool is depicted generally as 10 and is seen to be comprised of a circular base 11 having a removable nose piece 12 disposed thereon. The base 11 which is circular in cross section as seen in FIG. 2 is formed with opposed grooves 13,13 to accommodate the nose piece 12 as will be more fully explained hereinafter.

Figure 3:
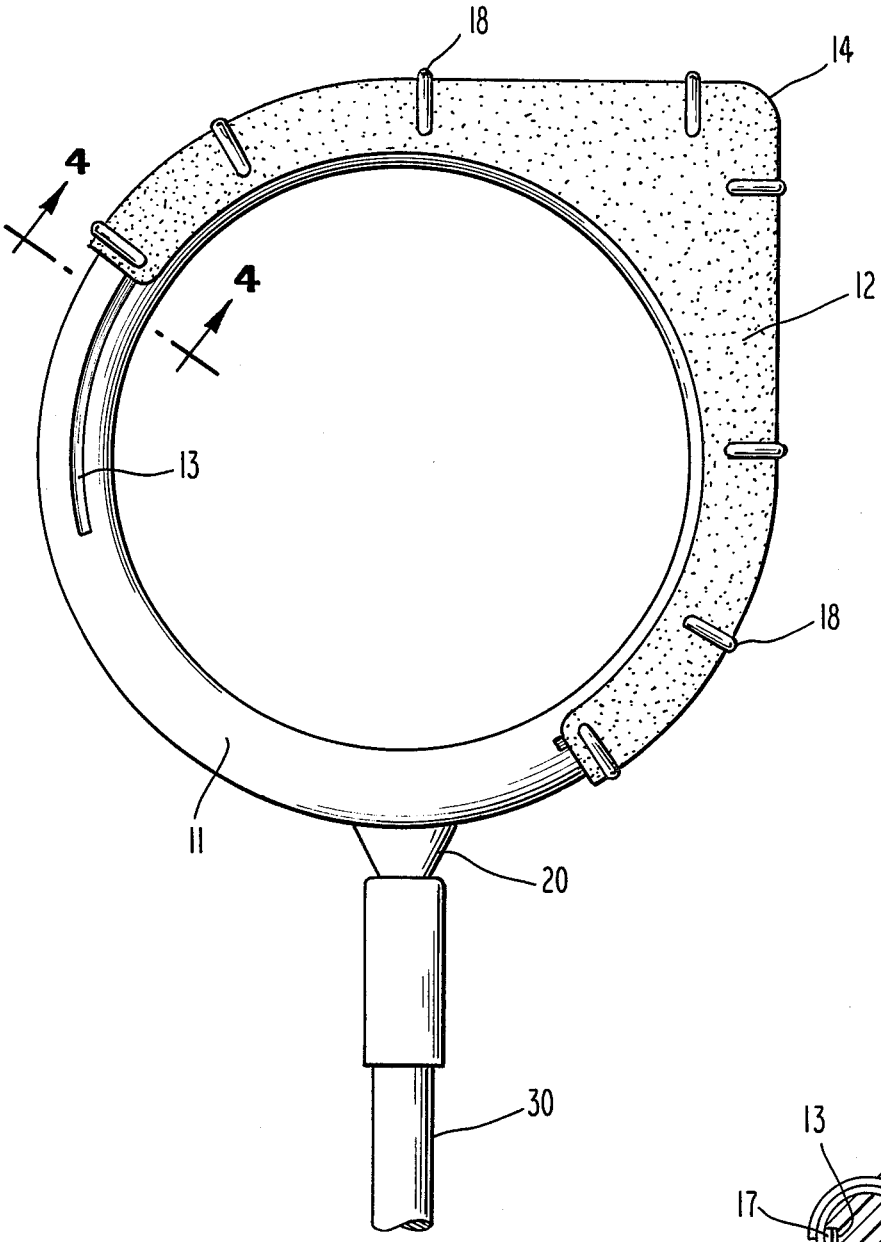
FIG. 3 is another front view of the cleaning head with the nose piece moved to an angulated position.

With continuing reference to FIG. 1, the nose piece 12 is seen to be of a single piece, V-shaped configuration having a nose portion 14 with depending legs 15,15. Each of the legs 15,15 are of a curved configuration in cross-section, see FIG. 4, and made of resilient material, preferably plastic, and of a dimension smaller than that of base 11 so that the same can grippingly engage the same and be maintained thereon in any position nothwithstanding any force being placed thereon. The interior surfaces of each of the legs 15,15 are provided with spaced protuberances 17,17 along its length which engage the grooves 13,13 for grippingly locking the nose piece 12 to the body 11 but permitting the same to be slidably moved thereon to accommodate any angular position as defined by the groove lengths. Preferably, the grooves 13, 13 extend over the major portion of the base 11 as seen when viewing FIGS. 1 and 3.

Additionally, a plurality of spaced semi-circular projections or bumpers 18,18 are disposed along the exterior length of the nose piece 12 to prevent the entire surface area thereof from contacting the wall in use for reasons to become apparent hereinafter. The exterior surface area of the nose piece 12 is covered with coating material such as flocking, bristles, velvet 19, to attract dust, cobwebs, dirt and maintain the same thereon for removal at the end of the cleaning operation. The coating material 19 can be secured to the surface of the nose piece 12 by adhesively securing the flocking directly thereto, or by placing the flocking on strips and adhesively securing the strips to the nose piece. Alternatively, fine bristle-like hairs can be formed directly on the exterior surface when manufacturing the same.

Figure 5:
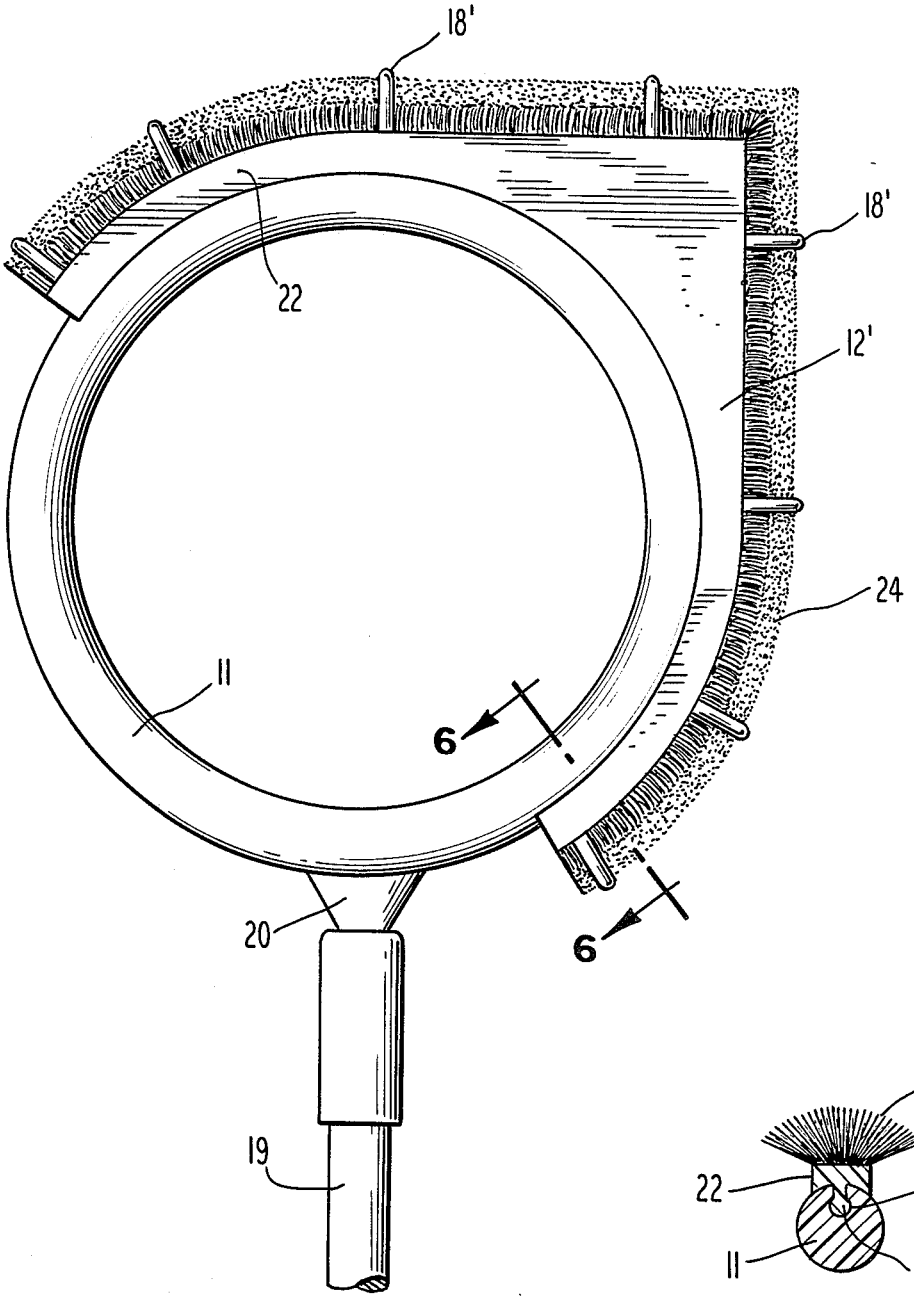
FIG. 5 is a front view of another embodiment of the cleaning head showing bristles associated therewith.
Figure 6:
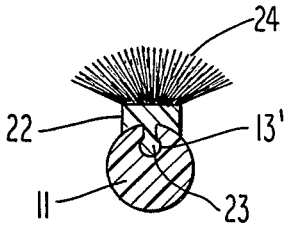
FIG. 6 is a sectional view taken on the line 6—6 of FIG. 5.

FIGS. 5 and 6 show a further embodiment of the cleaning tool of the present invention differing in the details of the nose piece 12'. As seen in FIG. 6, the nose piece 12' is formed of a curved support 22 having a depending element 23 disposed medially thereof. The element 23 in use is positioned in a single groove 13' formed in the top of the base 11, as distinguished from the two grooves of the previous embodiment.

The outer surface 19 of the nose piece 12' has bristles 24 covering the entire length thereof of a height shorter than that of the spaced bumpers or protuberances 18'.

Figure 4:
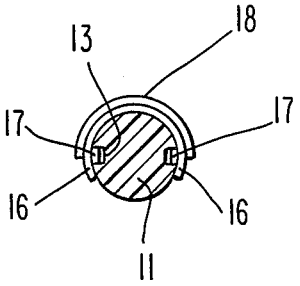
FIG. 4 is a sectional view taken on the line 4—4 of FIG. 3.

To assemble the cleaning tool, the nose piece 12 with the coating on the exterior thereof is grasped and lined up with the head 11, and forced thereon with the element 17,17 in one case, and 23 in the other, being positioned in the grooves 13,13' to be maintained therein by the resilient shape and formation of the legs 15,15 and the material from which it is fabricated. In use, an elongated handle 30 is positioned within a complementary socket 20 formed on the head 11 for manipulating the same. To use the tool, one merely adjusts the nose piece 12 to a desired angle, such as shown in FIG. 4, to accommodate the space between two abutting walls, and once positioned thereat, it is only necessary to walk the tool the length of the wall to remove dust, dirt and cobwebs therefrom. After material accumulates on the surface coating of the nose piece, one merely can remove the unwanted material by hand with a brush, a comb-like tool, or vacuum, preparatory to its being used again.

I claim:

1. A cleaning tool for household use in cleaning the surface of walls, ceilings, floors and the like, comprising a non-conical nose piece said nose piece having inner and outer surfaces and a nose end, cleaning means attached to said outer surface for attaching and holding debris removed from the surface during cleaning, at least one semi-circular, non-deformable protuberance being attached on said outer surface of said nose piece at a location spaced from said nose end, said proturberance (s) extending above said cleaning means to prevent any contact of the cleaning means with the surface to be cleaned.

2. The cleaning tool of claim 1 wherein the nose end is generally pointed.

3. The invention of claim 2 wherein the cleaning tool also includes a base for supporting the nose piece, which base includes one or more grooves and the nose piece has a plurality of spaced elements located on its inner surface for engaging the grooves for slidably maintaining the same therein.

4. The cleaning tool of claim 3 wherein the base and nose piece are generally circular in configuration.

5. The cleaning tool of claim 4 wherein a socket is forward on the base for the reception of a handle therein.

6. The cleaning tool of claim 5 wherein a handle is disposed in the socket.

7. The cleaning tool of claim 6 wherein the base and nose piece is made from plastic.

8. The cleaning tool of claim 7 wherein the cleaning means can be readily removed from the nose piece.

9. The cleaning tool of claim 7 wherein the cleaning means is formed directly on the nose piece.

* * * * *